US009854950B2

(12) United States Patent
Timothy

(10) Patent No.: US 9,854,950 B2
(45) Date of Patent: Jan. 2, 2018

(54) QUICK RELEASE TOILET SEAT FASTENER

(71) Applicant: Charles Richard Timothy, Midvale, UT (US)

(72) Inventor: Charles Richard Timothy, Midvale, UT (US)

( * ) Notice: Subject to any disclaimer, the term of this patent is extended or adjusted under 35 U.S.C. 154(b) by 197 days.

(21) Appl. No.: 14/614,151

(22) Filed: Feb. 4, 2015

(65) Prior Publication Data

US 2015/0216380 A1 Aug. 6, 2015

Related U.S. Application Data

(60) Provisional application No. 61/936,188, filed on Feb. 5, 2014.

(51) Int. Cl.
*A47K 13/26* (2006.01)

(52) U.S. Cl.
CPC ..... *A47K 13/26* (2013.01)

(58) Field of Classification Search
CPC ..... A47K 13/26
USPC ..... 4/236, 240
See application file for complete search history.

(56) References Cited

U.S. PATENT DOCUMENTS

| | | | | |
|---|---|---|---|---|
| 3,570,021 | A | 3/1971 | Watson | |
| 4,319,365 | A * | 3/1982 | Bemis | A47K 13/26 4/236 |
| 4,970,731 | A * | 11/1990 | Fait | A47K 13/26 4/234 |
| 5,933,875 | A | 8/1999 | Hulsebus et al. | |
| 2011/0296599 | A1* | 12/2011 | Brown | A47K 13/26 4/237 |
| 2013/0340154 | A1* | 12/2013 | Hand | A47K 13/12 4/240 |

* cited by examiner

*Primary Examiner* — Tuan N Nguyen
(74) *Attorney, Agent, or Firm* — Law Office of Paul B. Johnson; Paul Johnson

(57) ABSTRACT

A quick release toilet seat fastener for attaching a toilet seat to a toilet bowl. The quick release toilet seat fastener includes a fastener body having a fastener shaft and a plurality of ribs, wherein each of the plurality of ribs is connected to and positioned along the fastener shaft. Each of the plurality of ribs is flexible, having a inner curved surface and an outer curved surface that converge along a distal edge and delineate a horizontal cross section in conjunction with the fastener shaft. The fastener body is secured to a hinge base, wherein a flange head of the fastener body is positioned flush against the surface of the hinge base. A rib gap is positioned in between the plurality of ribs and the flange head, providing a region of empty space to allow for the full flexibility of each of the plurality of ribs.

20 Claims, 11 Drawing Sheets

QUICK RELEASE TOILET SEAT FASTENER

The current application claims a priority to the U.S. Provisional Patent application Ser. No. 61/936,188 filed on Feb. 5, 2014.

FIELD OF THE INVENTION

The present invention relates generally to toilet seat attachment mechanisms. More specifically, the present invention is a quick release toilet seat fastener that allows for the easy removal and attachment of toilet seats.

BACKGROUND OF THE INVENTION

Most people enjoy a clean, germ free toilet. Currently all toilet seats are attached to a toilet bowl using standard bolt fasteners that traverse through a hinge base of the toilet seat and into the smooth porcelain holes of the toilet bowl. Some of the toilet seats additionally employ a quick release locking system that allows the toilet seat to be easily removed from the toilet seat. The current quick release locking systems utilize a locking cap that is positioned over top or around the hinge base, wherein the locking cap can be detached from the hinge base through a twist mechanism or similar mechanism. However, for the current toilet seats that employ a quick release locking system, the hinge base is still attached to the toilet bowl using the standard bolt fastener.

Because the hinge base is attached to the toilet bowl using a standard bolt fastener, there are cracks and crevices between the hinge base and the toilet bowl in which dirt and germs can hide. In order to fully clean the toilet surface, the hinge base must be removed from the toilet bowl. The process of removing the hinge base from the toilet bowl is quite laborious and time consuming as the standard bolt fastener often used to secure the hinge base to the toilet bowl is quite long.

Therefore it is the object of the present invention to provide a quick release toilet seat fastener that can be used with any toilet seat and any toilet bowl. The present invention allows a toilet seat to be removed almost instantly and leaves no parts bolted or otherwise attached to the toilet bowl, thus leaving a smooth porcelain surface which can be easily sterilized. The present invention comprises a fastener body having a fastener shaft to which a plurality of ribs is connected along; the plurality of ribs extending outwards, away from the fastener shaft. The fastener body is attached to the hinge base, wherein the plurality of ribs extend downwards, away from the hinge base. The fastener shaft and the plurality of ribs are positioned into one of the smooth porcelain holes of the toilet bowl, wherein the plurality of ribs grips the smooth porcelain, securely holding the hinge base in place against the toilet bowl. Additionally, each of the plurality of ribs is flexible in order to account for variations in the diameter of the smooth porcelain holes in the toilet bowl that can occur between different toilets. Using two of the present invention to secure a toilet seat, a user simply lifts and pulls up on the toilet seat in order to disengage the plurality of ribs of each quick release toilet seat fastener from the smooth porcelain holes. The entire toilet lid can then be laid in the tub or shower, cleaned and disinfected, and then installed back onto the toilet bowl in a matter of seconds.

DETAIL DESCRIPTIONS OF THE INVENTION

All illustrations of the drawings are for the purpose of describing selected versions of the present invention and are not intended to limit the scope of the present invention.

The present invention is a quick release toilet seat fastener for securing a toilet seat to a toilet bowl. The present invention is used in place of a standard bolt fastener that is typically used to secure a toilet seat to a toilet bowl. The present invention comprises a fastener body 10, a plurality of ribs 20, and a rib gap 30. The present invention may be implemented as a universal retro fit kit for installing toilet seats, or the present invention may be configured directly into a toilet seat.

Figure 1:
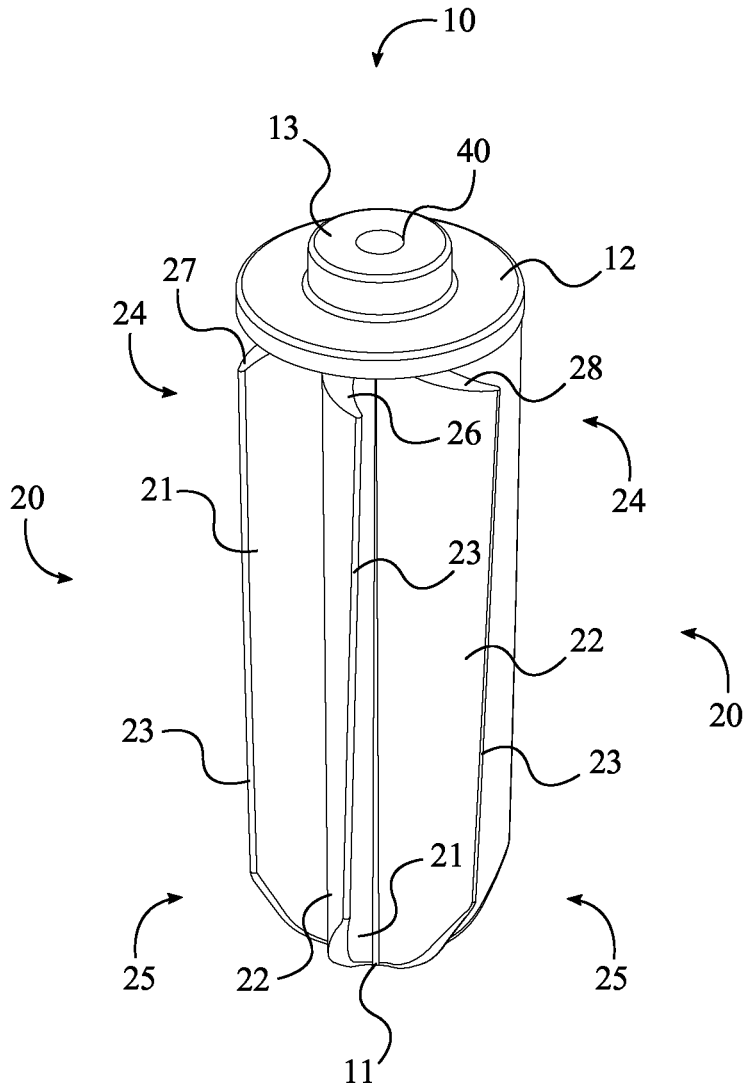
FIG. 1 is a perspective view of the present invention.
Figure 2:
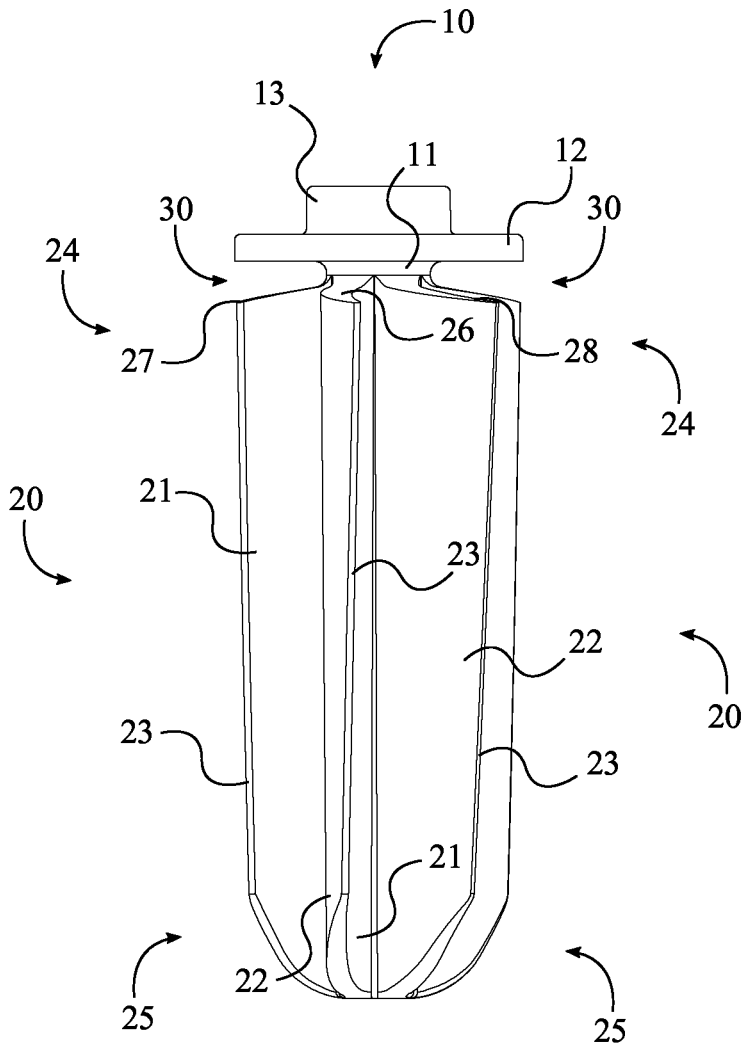
FIG. 2 is a front elevational view of the present invention.

In reference to FIG. 1-2, the fastener body 10 comprises a fastener shaft 11, a flange head 12, and a hinge insert 13. The fastener shaft 11 is an elongated member that delineates the structuring of the plurality of ribs 20. The fastener shaft 11 is adjacently connected to the flange head 12, and is concentrically positioned with the flange head 12. The flange head 12 is a relatively flat section of the fastener body 10 that extends radially from the fastener shaft 11. The flange head 12 provides a surface for engaging the toilet seat, wherein the flange head 12 is positioned flush against the toilet seat.

Figure 8:
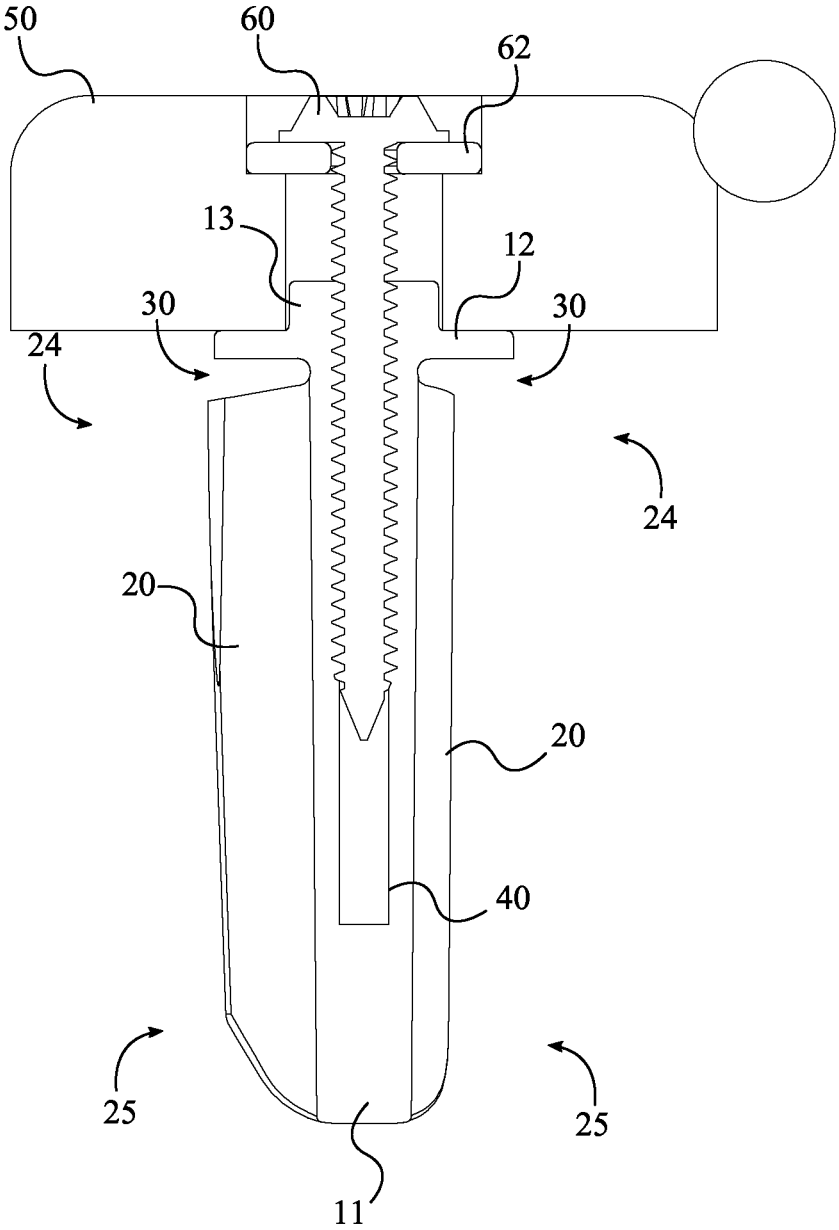
FIG. 8 is a right side sectional view of the present invention attached to the hinge base using the washer and set screw.

In further reference to FIG. 1-2, the hinge insert 13 is adjacently connected to the flange head 12 opposite the fastener shaft 11. Additionally, the hinge insert 13 is concentrically positioned with the flange head 12. The flange insert is positioned into a hinge base 50 of the toilet seat, such that the fastener shaft 11 extends away from the hinge base 50, as shown in FIG. 8. The hinge base 50 is the portion of the toilet seat that anchors the toilet seat to the toilet bowl, and is typically attached to the toilet bowl using the standard bolt fastener. The hinge insert 13 ensures that the fastener body 10 is properly aligned with the hinge base 50 and prevents the fastener body 10 from shifting around. The hinge insert 13 is positioned into the hinge base 50, wherein the flange head 12 is pressed flush against the hinge base 50.

Figure 3:
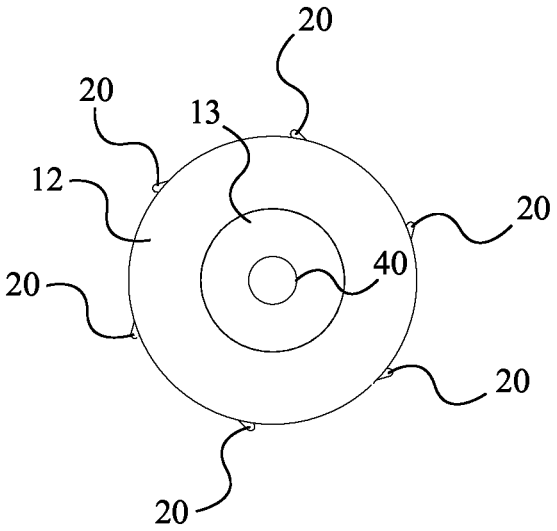
FIG. 3 is a top plan view of the present invention.
Figure 4:
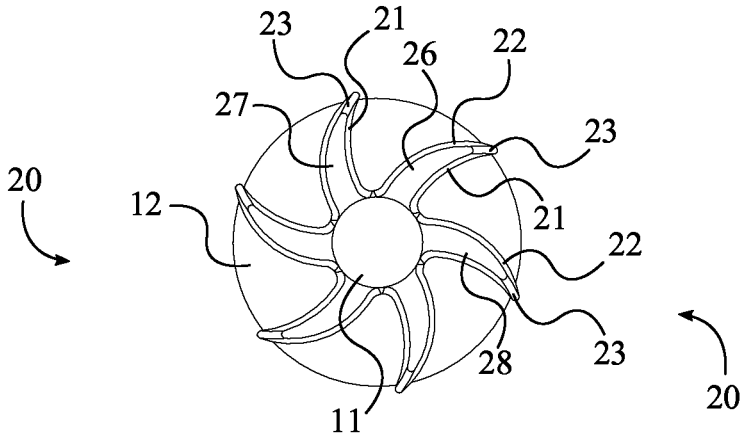
FIG. 4 is a bottom plan view of the present invention.

In reference to FIG. 3-4, the plurality of ribs 20 is radially positioned about the fastener shaft 11, wherein each of the plurality of ribs 20 is adjacently connected to the fastener shaft 11. Each of the plurality of ribs 20 is positioned along the fastener shaft 11, as shown in FIG. 2, and is flexible, such that the plurality of ribs 20 is able to conform to various hole diameters. The fastener shaft 11 and the plurality of ribs 20 are positioned into one of the smooth porcelain holes of the toilet bowl in which the standard bolt fastener is typically positioned into and used to secure the toilet seat to the toilet bowl. As the diameter of the smooth porcelain holes of the toilet bowl may vary from toilet to toilet, typically from ⅝ inch to ½ inch, the flexibility of the plurality of ribs 20 allows each of the plurality of ribs 20 to conform to any toilet bowl.

In the preferred embodiment of the present invention, the plurality of ribs 20 is specifically six ribs, as shown in FIG. 4. However, more or less ribs may be utilized in other embodiments of the present invention according to factors such as functional requirements or cost effectiveness.

In reference to FIG. 2, the rib gap 30 is positioned around the fastener shaft 11 and in between the plurality of ribs 20 and the flange head 12. The rib gap 30 provides a region of empty space between the plurality of ribs 20 and the flange head 12 to allow for the full flexibility of the plurality of ribs 20. By providing the rib gap 30, each of the plurality of ribs 20 may fully flex within one of the smooth porcelain holes of the toilet bowl, wherein the fastener shaft 11 can be fully positioned within the smooth porcelain hole with the flange head 12 being pressed flush against the surface of the toilet bowl. If the rib gap 30 were to not be present, then each of the plurality of ribs 20 would not be able to fully flex, as each of the plurality of ribs 20 would be connected to the flange head 12.

In reference to FIG. 1-2, each of the plurality of ribs 20 comprises a proximal end 24, a distal end 25, a curved inner surface 21, and a curved outer surface 22. The proximal end 24 and the distal end 25 of each of the plurality of ribs 20 are positioned opposite each other along the length of the fastener shaft 11; the proximal end 24 being positioned adjacent to the rib gap 30. The distal end 25 is tapered away from the proximal end 24 in order to allow the plurality of ribs 20 to more readily be inserted into one of the smooth porcelain holes of the toilet bowl. The tapered design of the distal end 25 allows the fastener shaft 11 and the plurality of ribs 20 to be inserted into one of the smooth porcelain holes of the toilet bowl without being precisely aligned with the smooth porcelain hole of the toilet bowl, thus allowing the present invention to be used to quickly attach the toilet seat to the toilet bowl.

The curved inner surface 21, the curved outer surface 22, and the fastener shaft 11 delineate the horizontal cross sectional area of each of the plurality of ribs 20; the inner curved surface and the outer curved surface defining the curved nature of each of the plurality of ribs 20. Each of the plurality of ribs 20 is curved in order to ensure that each of the plurality of ribs 20 flexes in the same direction when the present invention is positioned into one of the smooth porcelain holes of the toilet bowl. The curved inner surface 21 and the curved outer surface 22 of each of the plurality of ribs 20 converge along a distal edge 23; the distal edge 23 being positioned away from the fastener shaft 11. The convergence of the inner curved surface and the outer curved surface along the distal edge 23 geometrically defines each of the plurality of ribs 20, such that the flexibility of each of the plurality of ribs 20 increases closer to the distal edge 23 and decreases closer to the fastener shaft 11.

In reference to FIG. 4, the curved inner surface 21 and the curved outer surface 22 are oriented on the same side of each of the plurality of ribs 20, such that each of the plurality of ribs 20 is curved in the same clockwise or counterclockwise direction around the fastener shaft 11. More specifically, for an arbitrary rib 26 selected from the plurality of ribs 20 there is a preceding rib 27 and a subsequent rib 28 also from the plurality of ribs 20; the preceding rib 27 and the subsequent rib 28 being positioned adjacent to the arbitrary rib 26, wherein the arbitrary rib 26 is positioned in between the preceding rib 27 and the subsequent rib 28. The outer curved surface of the arbitrary rib 26 is positioned adjacent to the inner curved surface of the preceding rib 27, while the inner curved surface of the arbitrary rib 26 is positioned adjacent to the outer curved surface of the subsequent rib 28.

Figure 5:
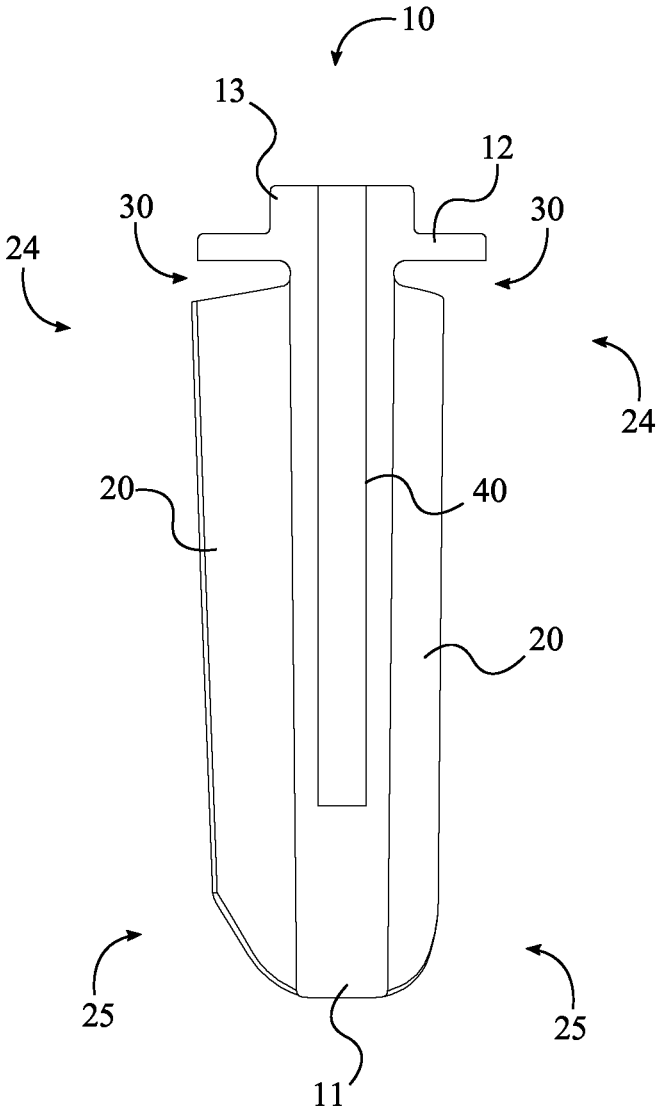
FIG. 5 is a front sectional view of the present invention.
Figure 6:
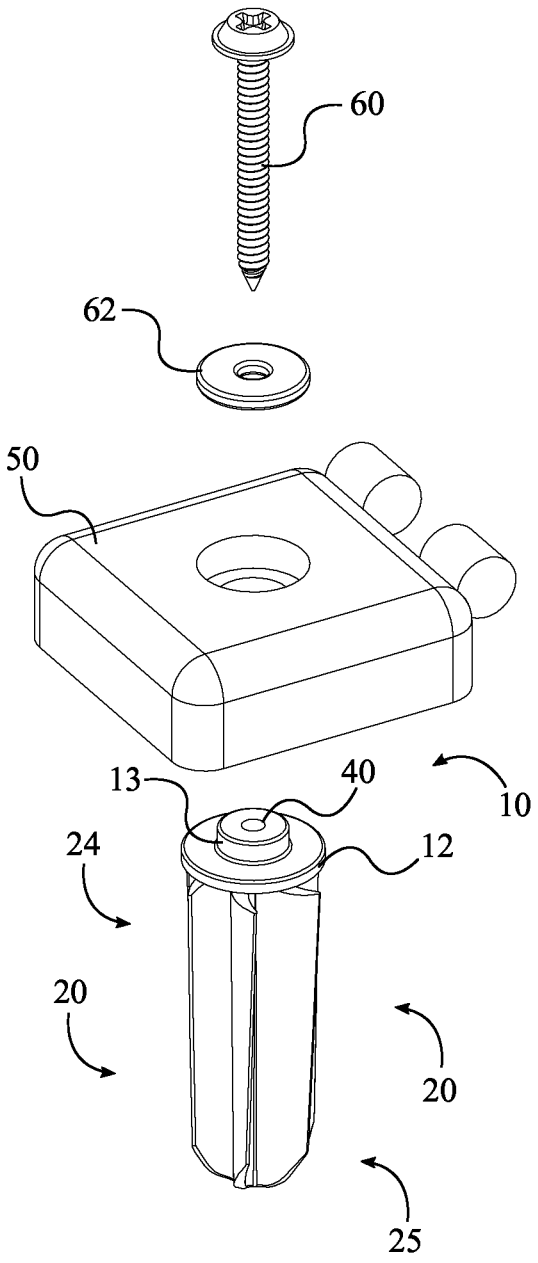
FIG. 6 is a an exploded view of the present invention in conjunction with a hinge base, washer, and set screw.

The present invention can be designed as an aftermarket attachment mechanism, or can be integrated directly into the toilet seat. In reference to FIG. 5-6, in the preferred embodiment of the present invention, the present invention further comprises a receiving channel 40, a set screw 60, and a washer 62; wherein the present invention can be used in conjunction with any existing toilet in place of the standard bolt fastener. The receiving channel 40 longitudinally traverses into the fastener body 10 through the hinge insert 13, wherein the receiving channel 40 is concentrically aligned with the hinge insert 13, the flange head 12, and the fastener shaft 11.

Figure 7:
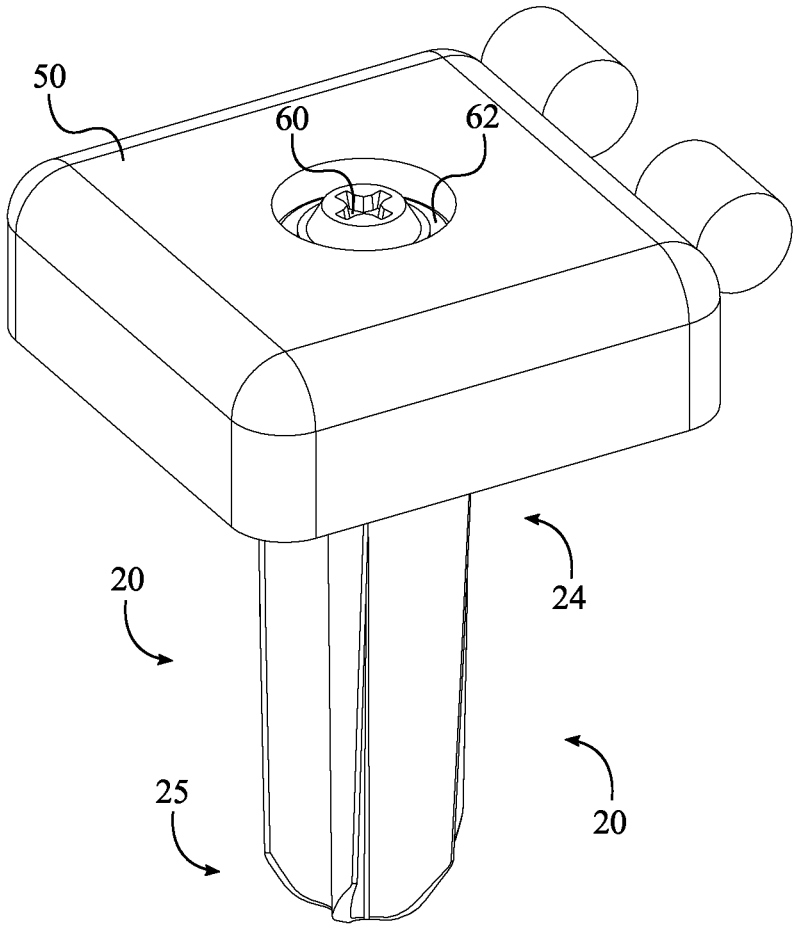
FIG. 7 is a perspective view of the present invention attached to the hinge base using the washer and set screw.

In reference to FIG. 7-8, the hinge insert 13 is positioned into the hinge base 50 and the set screw 60 is then positioned through both the washer 62 and the hinge base 50, and into the receiving channel 40. The washer 62 is positioned into the hinge base 50 opposite the hinge insert 13; the portion of the hinge base 50 where the head of the standard bolt fastener would typically rest. The washer 62 stabilizes the set screw 60 and ensures that the set screw 60 is properly centered for engaging the receiving channel 40. The set screw 60 is a self-tapping screw, wherein the threads of the set screw 60 engage and tap the inner walls of the fastener body 10 as the set screw 60 is positioned into the receiving channel 40. The set screw 60 is tightened into the fastener body 10, thus securing the fastener body 10 to the hinge base 50, wherein the set screw 60 is tightened until the head of the set screw 60 rests flush against the washer 62.

Figure 9:
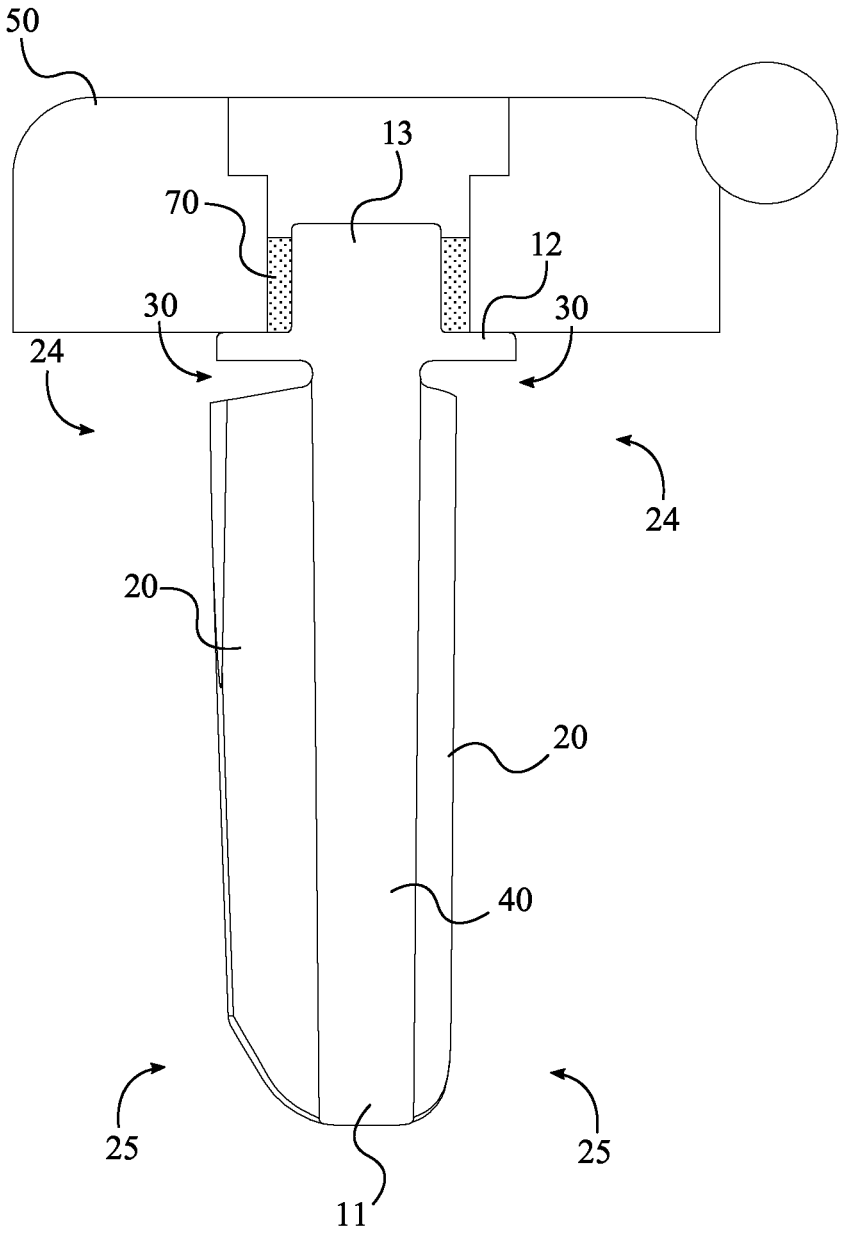
FIG. 9 is a right side sectional view of the present invention attached to the hinge base using an adhesive.

In reference to FIG. 9, in another embodiment of the present invention, the fastener body 10 is secured to the hinge body without the use of the receiving channel 40, the set screw 60, and the washer 62. Rather, an adhesive 70 is utilized to secure the hinge insert 13 to the hinge base 50. The adhesive 70 is applied to the hinge insert 13, the hinge base 50, or both the hinge insert 13 and the hinge base 50. The hinge insert 13 is then positioned into the hinge base 50, wherein the adhesive 70 is allowed to set, forming a bond between the hinge insert 13 and the hinge base 50.

Figure 10:
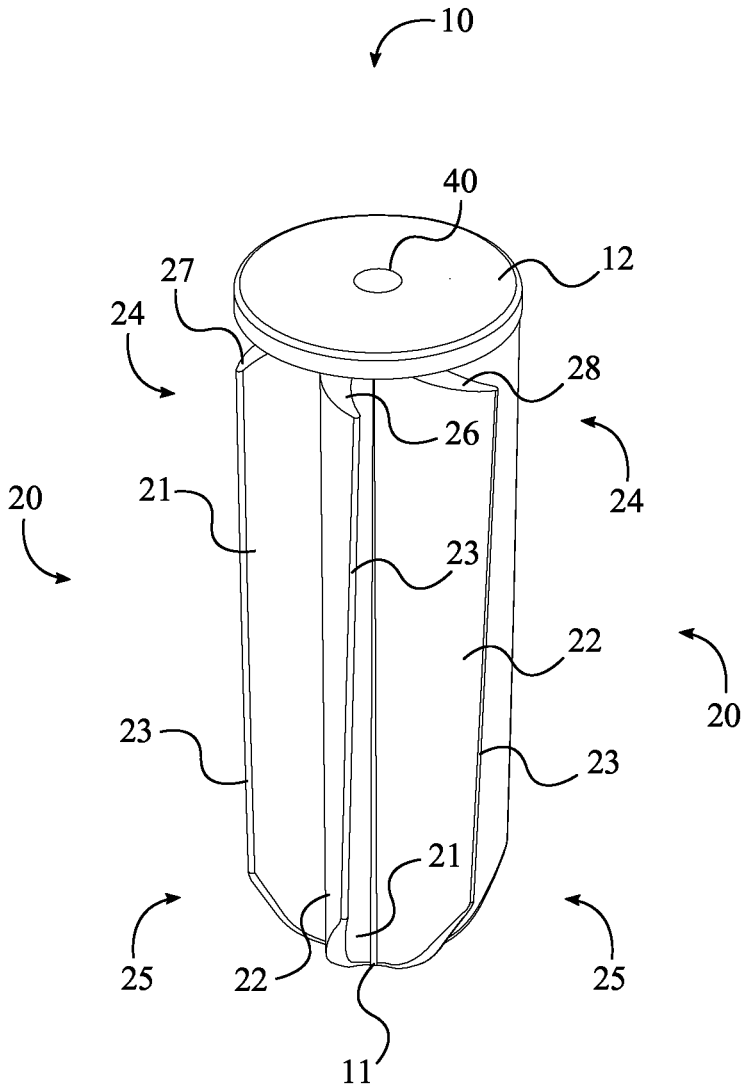
FIG. 10 is a perspective view of an alternative embodiment of the present invention.

In yet another embodiment of the present invention, the fastener body 10 can be formed without the hinge insert 13 as shown in FIG. 10, wherein the receiving channel 40, the set screw 60, and the washer 62 are used to secure the fastener body 10 to the hinge base 50. In such an embodiment, the receiving channel 40 longitudinally traverses into the fastener body 10 through the flange head 12, wherein the receiving channel 40 is concentrically aligned with the flange head 12 and the fastener shaft 11. The flange head 12 is positioned flush against the hinge base 50 and the set screw 60 is then positioned through both the washer 62 and the hinge base 50, and into the receiving channel 40.

Figure 11:
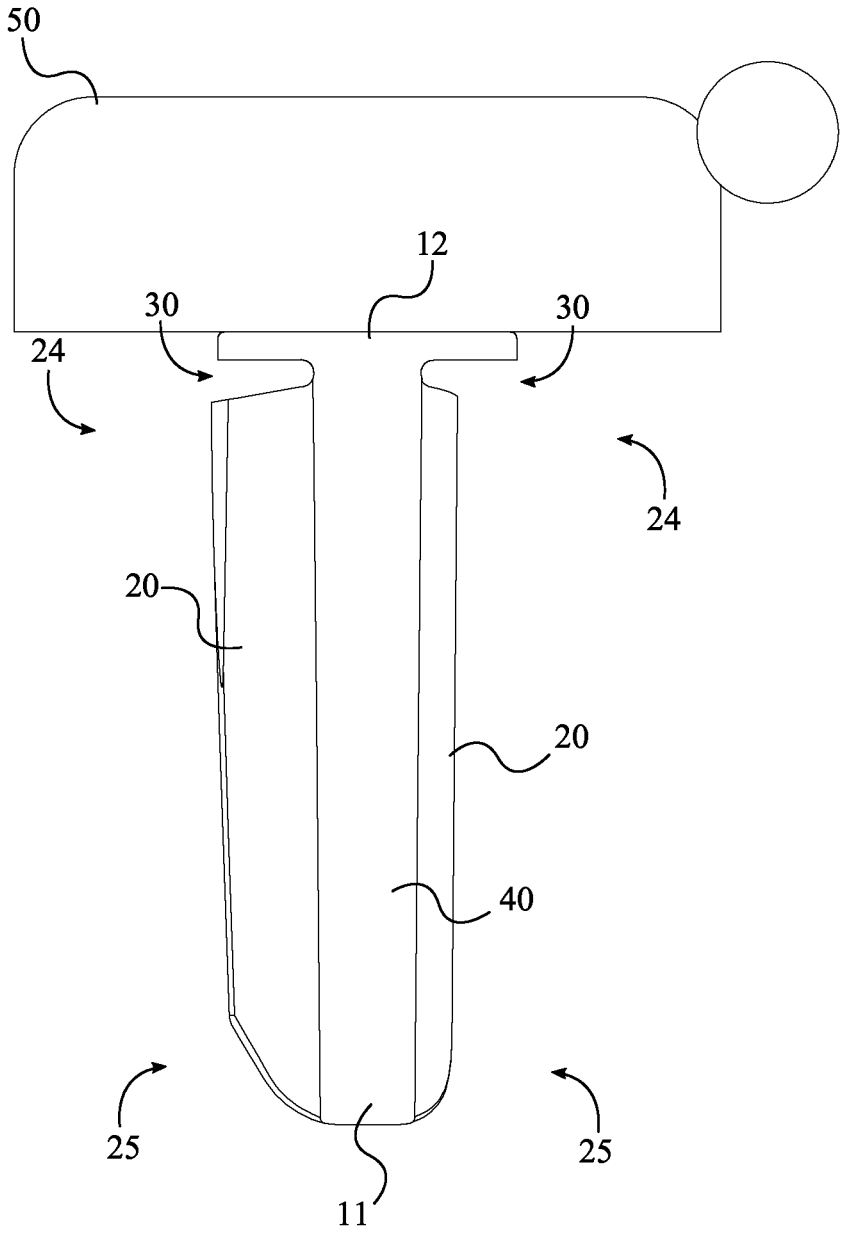
FIG. 11 is a right side sectional view of the present invention, wherein the hinge base is connected to the flange head.

In reference to FIG. 11, in embodiments of the present invention where the present invention is directly integrated into the toilet seat hinge, the fastener body 10 is adjacently connected to the hinge base 50. More specifically, the hinge base 50 is adjacently connected to the flange head 12 opposite the fastener shaft 11. In this way, the present invention is built into the construction of the toilet seat hinge, replacing the standard bolt fastener, wherein the toilet seat can then be used with any toilet bowl construction. Additionally, this allows the fastener shaft 11, the plurality of ribs 20, and the hinge base 50 to be constructed as a single piece of material if deemed beneficial cost wise, structural wise, etc.

In the preferred embodiment of the present invention, the fastener body 10 and the plurality of ribs 20 are constructed using plastic mold injection using the appropriate types of plastic. Such plastics may include, but are not limited to, high density polytetrafluoroethylene, nylon, polyurethane, or soft polyvinyl chloride. It is also possible for the fastener body 10 and the plurality of ribs 20 to be constructed using any other appropriate manufacturing method or materials.

Additionally, in the preferred embodiment of the present invention, the set screw 60 is constructed from stainless steel or galvanized steel. However, it is possible for the set screw 60 to be constructed from any other material.

Although the invention has been explained in relation to its preferred embodiment, it is to be understood that many other possible modifications and variations can be made without departing from the spirit and scope of the invention as hereinafter claimed.

What is claimed is:

1. A quick release toilet seat fastener comprises:
a fastener body;
a plurality of ribs;
a rib gap;
the fastener body comprises a fastener shaft and a flange head;
the fastener shaft being adjacently connected to the flange head;
the fastener shaft being concentrically positioned with the flange head;
the plurality of ribs being radially positioned about the fastener shaft;
each of the plurality of ribs being adjacently connected to the fastener shaft;
each of the plurality of ribs begin positioned along the fastener shaft;
each of the plurality of ribs being flexible;
the rib gap being positioned around the fastener shaft; and
the rib gap being positioned in between the plurality of ribs and the flange head;
wherein each rib comprises a longest length substantially parallel with a longest length of the fastener shaft.

2. The quick release toilet seat fastener as claimed in claim 1 further comprises:
each of the plurality of ribs comprises a curved inner surface and a curved outer surface;
the curved inner surface and the curved outer surface converging along a distal edge; and
the distal edge being positioned away from the fastener shaft;
wherein each distal edge comprises a longest length substantially parallel with the longest length of the fastener shaft.

3. The quick release toilet seat fastener as claimed in claim 2 further comprises:
each curved inner surface is positioned adjacent to one of the curved outer surfaces.

4. The quick release toilet seat fastener as claimed in claim 3 further comprises:
wherein each curved inner surface faces one of the curved outer surfaces.

5. The quick release toilet seat fastener as claimed in claim 1 further comprises:
each of the plurality of ribs comprises a proximal end and a distal end being positioned opposite each other;
the proximal end being positioned adjacent to the rib gap; and
the distal end being tapered away from the proximal end and a distance between the distal end and the flange head being greater than a distance between the proximal end and the flange head.

6. The quick release toilet seat fastener as claimed in claim 1 further comprises:
the fastener body further comprises a hinge insert;
the hinge insert being permanently adjacently connected to the flange head opposite the fastener shaft; and
the hinge insert being concentrically positioned with the flange head.

7. The quick release toilet seat fastener as claimed in claim 6 further comprises:
a receiving channel; and
the receiving channel longitudinally traversing into the fastener body through the hinge insert;
wherein the receiving channel comprises no threads until a set screw is used to fasten the fastener body with a hinge base.

8. The quick release toilet seat fastener as claimed in claim 7 further comprises:
the hinge base;
the set screw;
the hinge insert being positioned into the hinge base; and
the set screw being positioned through the hinge base into the receiving channel;
wherein the fastener shaft is not configured to expand during insertion of the set screw into the receiving channel.

9. The quick release toilet seat fastener as claimed in claim 6 further comprises:
an adhesive; and
the hinge insert being connected to the hinge base by the adhesive, and;
wherein the quick release toilet seat fastener does not comprise a set screw.

10. The quick release toilet seat fastener as claimed in claim 1 further comprises:
a receiving channel; and
the receiving channel longitudinally traversing into the fastener body through the flange head;
wherein the flange head and the fastener body are permanently coupled together.

11. The quick release toilet seat fastener as claimed in claim 10 further comprises:
a hinge base;
a set screw;
the flange head being positioned adjacent to the hinge base; and
the set screw being positioned through the hinge base into the receiving channel;
wherein the quick release toilet seat fastener is manually removable from a hole of a toilet bowl, after full installation of the quick release toilet seat fastener into the hole of the toilet bowl, without removal of the set screw from the receiving channel.

12. The quick release toilet seat fastener as claimed in claim 1 further comprises:
a hinge base; and
the hinge base being adjacently connected to the flange head opposite the fastener shaft;
wherein each rib is configured to deform towards another one of the plurality of ribs as the fastener shaft is pressed into a hole of a toilet bowl.

13. A quick release toilet seat fastener comprises:
a fastener body;
a plurality of ribs;
a rib gap;

each of the plurality of ribs comprises a curved inner surface and a curved outer surface, each curved inner surface positioned adjacent to one of the curved outer surfaces;

the fastener body comprises a fastener shaft, a flange head, and a hinge insert;

the fastener shaft being adjacently connected to the flange head;

the fastener shaft being concentrically positioned with the flange head;

the hinge insert being adjacently connected to the flange head opposite the fastener shaft;

the hinge insert being concentrically positioned with the flange head;

the plurality of ribs being radially positioned about the fastener shaft;

each of the plurality of ribs being adjacently connected to the fastener shaft;

each of the plurality of ribs being positioned along the fastener shaft;

each of the plurality of ribs being flexible;

the curved inner surface and the curved outer surface converging along a distal edge;

the distal edge being positioned away from the fastener shaft;

the rib gap being positioned around the fastener shaft; and the rib gap being positioned in between the plurality of ribs and the flange head.

14. The quick release toilet seat fastener as claimed in claim 13 further comprises:

wherein each curved inner surface faces one of the curved outer surfaces.

15. The quick release toilet seat fastener as claimed in claim 13 further comprises:

each of the plurality of ribs further comprises a proximal end and a distal end being positioned opposite each other;

the proximal end being positioned adjacent to the rib gap; and the distal end being tapered away from the proximal end and being flush with an end of the fastener shaft furthest from the flange head.

16. The quick release toilet seat fastener as claimed in claim 13 further comprises:

a receiving channel; and the receiving channel longitudinally traversing into the fastener body through the hinge insert;

wherein the receiving channel is not accessible through a distal end of the fastener shaft furthest from the hinge insert.

17. The quick release toilet seat fastener as claimed in claim 16 further comprises:

a hinge base;

a set screw;

the hinge insert being positioned into the hinge base; and the set screw being positioned through the hinge base into the receiving channel;

wherein the receiving channel is accessible only through the hinge insert.

18. A quick release toilet seat fastener comprises:

a fastener body;

a plurality of ribs;

a rib gap;

a hinge base;

each of the plurality of ribs comprises a curved inner surface and a curved outer surface;

the fastener body comprises a fastener shaft and a flange head;

the fastener shaft being adjacently connected to the flange head;

the fastener shaft being concentrically positioned with the flange head;

the hinge base being adjacently connected to the flange head opposite the fastener shaft;

the plurality of ribs being radially positioned about the fastener shaft;

each of the plurality of ribs being adjacently connected to the fastener shaft;

each of the plurality of ribs being positioned along the fastener shaft;

each of the plurality of ribs being flexible;

the curved inner surface and the curved outer surface converging along a distal edge;

the distal edge being positioned away from the fastener shaft;

the rib gap being positioned around the fastener shaft; and the rib gap being positioned in between the plurality of ribs and the flange head;

wherein the quick release toilet seat fastener is configured to fastened a toilet lid to a hole of a toilet bowl without the use of a set screw.

19. The quick release toilet seat fastener as claimed in claim 18 further comprises:

wherein each rib is configured to deform by curving towards another one of the plurality of ribs during installation of the fastener shaft into the hole of the toilet bowl.

20. The quick release toilet seat fastener as claimed in claim 18 further comprises:

wherein each curved inner surface faces one of the curved outer surfaces.

* * * * *